United States Patent [19]

Doyle et al.

[11] 4,093,450

[45] June 6, 1978

[54] PRODUCTION OF ULTRAFINE COBALT POWDER FROM DILUTE SOLUTION

[75] Inventors: Barry N. Doyle; Willie H. Seibt, both of Edmonton; Kshitindra Mohan Sarkar, St. Albert; Mark R. Benz, Fort Saskatchewan, all of, Calif.

[73] Assignee: Sherritt Gordon Mines Limited, Toronto, Canada

[21] Appl. No.: 796,241

[22] Filed: May 12, 1977

[30] Foreign Application Priority Data

Mar. 7, 1977 Canada ..... 273334

[51] Int. Cl.[2] ..... C22B 23/04

[52] U.S. Cl. ..... 75/0.5 AA; 75/.5 BA; 75/119

[58] Field of Search ..... 75/.5 AA, .5 BA, 119

[56] References Cited

U.S. PATENT DOCUMENTS

| | | | |
|---|---|---|---|
| 2,744,003 | 5/1956 | Schaufelberger et al. | 75/.5 AA |
| 2,853,374 | 9/1958 | Schaufelberger | 75/.5 AA |
| 3,775,098 | 11/1973 | Kunda et al. | 75/.5 AA |
| 3,975,217 | 8/1976 | Kunda et al. | 75/.5 AA |

*Primary Examiner*—W. Stallard

*Attorney, Agent, or Firm*—Robert F. Delbridge; Arne I. Fors

[57] ABSTRACT

A process for producing ultrafine cobalt powder includes providing an aqueous solution of cobalt ammine carbonate, with the concentration of cobalt ions being in the range of from about 1 to about 20 grams per liter (gpl). The solution is heated to drive off ammonia and carbon dioxide and precipitate ultrafine cobalt oxide. The cobalt oxide precipitate is then separated from the solution and heated in a reducing atmosphere to reduce the cobalt oxide to ultrafine cobalt powder.

10 Claims, 1 Drawing Figure

PRODUCTION OF ULTRAFINE COBALT POWDER FROM DILUTE SOLUTION

Figure 1:
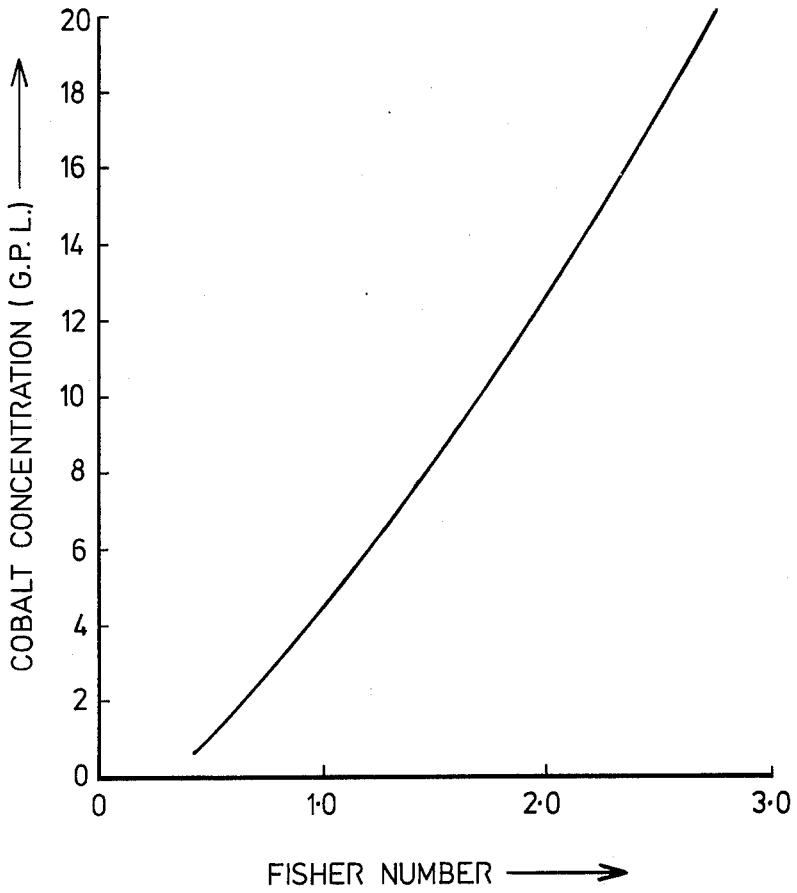

This invention relates to the production of ultrafine cobalt powder, that is to say cobalt powder with a particle size up to about 3 microns.

Such cobalt is used for example in the manufacture of cemented carbide tools, such as stamping and cutting tools, magnets, magnetic tapes and magentic inks, and as a nucleating agent in casting processes. For such uses, the cobalt powder must be not only ultrafine, but must also be of relatively high purity. For example, the oxygen content should be less than about 2% by weight.

Prior processes for the production of ultrafine cobalt powder have not been satisfactory on a commercial scale, because the control of particle size and/or purity of the powder has been relatively difficult. Another problem connected with manufacture of ultrafine cobalt powder is its pyrophoric nature, as a result of which special precautions have to be taken.

According to the present invention, ultrafine cobalt powder is produced by providing an aqueous solution of cobalt ammine carbonate in which the concentration of cobalt ions is within the range of from about 1 to about 20 grams per liter, heating the solution to drive off ammonia and carbon dioxide and precipitate ultrafine cobalt oxide, separating the cobalt oxide precipitate from the solution, and heating the separated cobalt oxide precipitate in a reducing atmosphere to reduce the cobalt oxide to ultrafine cobalt powder.

The invention utilizes the finding that the size of the cobalt oxide particles precipitated, and the size of the cobalt powder produced in the subsequent reduction step, can be controlled by adjusting the concentration of cobalt ions in the solution within the range specified before heating to cause the precipitation of cobalt oxide. The invention also utilizes the finding that such a process is capable of producing ultrafine cobalt powder with a satisfactory low oxygen content. Further, although it is preferable that substantially all cobalt ions in the cobalt ammine carbonate solution be in the cobaltic state, it has been found that this is not essential.

The starting solution of cobalt ammine carbonate may be prepared in any convenient manner. One way of preparing a suitable starting solution is by leaching cobalt metal under oxidizing conditions in an ammoniacal ammonium carbonate solution.

The ammoniacal ammonium carbonate solution may be prepared in any convenient manner. For example, ammonia gas may first be passed into water, with carbon dioxide gas then being passed into the resulting ammonia solution. These steps can be carried out at atmospheric pressure, preferably at a temperature below about 65° C. and preferably with good agitation of the solution. For the subsequent leaching step, the solution should preferably contain from 120 to 180 gpl ammonia and from 50 to 70 gpl carbon dioxide. There should be at least 3 moles of free ammonia in the solution for every mole of ammonium carbonate.

The cobalt starting material is preferably in the form of cobalt particles with a size less than about 3 mm. Still more preferably, the cobalt starting material is cobalt powder with an average particle size of less than about 100 microns.

The cobalt starting material is preferably leached in the ammoniacal ammonium carbonate solution under oxidizing conditions at elevated temperature and pressure. A temperature in the range of 50° C. to 80° C. is preferred. Since the reaction may be exothermic when the starting material is relatively fine, some form of cooling may be necessary to maintain the temperature in the desired range. Oxygen is a preferred oxidizing agent and may be supplied in the form of pure oxygen, air or oxygen enriched air. However, other oxidizing agents such as hydrogen peroxide may be used instead of oxygen. The total pressure is preferably in the range of 400 to 1000 kPa, more preferably in the range of 500 to 700 kPa, with a partial oxygen pressure preferably in the range of 80 to 200 kPa, and more preferably in the range of 100 to 140 kPa.

The amount of cobalt starting material added to the ammoniacal ammonium carbonate leach is preferably in the range of from 20 to 120 gpl and the solution should be well agitated to cause the cobalt to dissolve in a reasonable time. The leaching step is continued until substantially all the cobalt is dissolved, and preferably continued thereafter until substantially all initially formed cobaltous ions have been oxidized to cobaltic ions, since this appears to give a finer precipitate.

The overall reaction in the leaching step is:

$$3NH_3 + Co + (NH_4)_2CO_3 + 0.5O_2 \rightarrow Co(NH_3)_5CO_3 + H_2O.$$

After the leaching step, undissolved material is removed by an appropriate separation step, for example filtration. Also, if necessary, the solution can be purified to remove undesired dissolved impurities, for example by means of ion exchange techniques. The solution is then diluted with water to adjust the concentration of cobalt ions to a value in the range of 1 to 20 gpl, preferably 5 to 8 gpl. As mentioned previously, the present invention utilizes the finding that the size of cobalt oxide particles which are precipitated in the subsequent heating step is dependent upon the cobalt ion concentration in the solution. It is unexpected that the desired particle size could be controlled by adjusting the cobalt ion concentration to a value in the range specified.

After the cobalt ion concentration adjustment step, the solution is heated, and preferably also well agitated, to drive off ammonia and carbon dioxide and precipitate ultrafine cobalt oxide. Such heating, i.e. boiling, of the solution may be accomplished, for example, by passing pressurized steam at any convenient pressure into the solution. The steam also functions to effectively agitate the solution. This heating step is continued until very little cobalt remains in solution. The ammonia and carbon dioxide released from the solution can be recycled to the previously described ammoniacal ammonium carbonate solution production step.

The cobalt oxide precipitate is then separated from the solution in an appropriate separation step, for example, filtration, and the separated precipitate is heated in a reducing atmosphere to reduce the cobalt oxide to ultrafine cobalt powder. Hydrogen is a suitable reducing gas for this purpose, and a convenient temperature range is 500° to 775° C. In this heating step, the cobalt oxide precipitate may be conveniently passed through a furnace on a moving belt, with the furnace containing a hydrogen atmosphere. To prevent oxygen from entering the furnace, the entrance and exit areas of the furnace may be purged with a gas, such as nitrogen, which is inert so far as chemical reaction with cobalt oxide or cobalt is concerned. An increase in particle size occurs during the reduction step, that is to say the particle size of the resultant cobalt powder is somewhat larger than the particle size of the cobalt oxide pwoder.

The oxygen content of the resultant cobalt product is to some extent dependent upon the cobalt oxide particle size and temperature of the reduction step, a somewhat higher temperature being required for finer oxide particles to maintain oxygen contamination below a predetermined amount.

After the reduction step, the cobalt powder product is very susceptible to contamination by oxygen and should not be allowed to come into contact with an oxygen containing atmosphere. From the reduction step, the cobalt powder product should be discharged into an inert atmosphere, for example, an argon atmosphere. The relatively high temperature of the reduction step may cause some sintering of the cobalt powder particles to take place, so that some agglomerations are present. These can be broken up by pulverization in the inert atmosphere. Similarly, the pulverized powder may be screened in an inert atmosphere, and then packaged in air-tight containers.

Specific examples of the invention will now be described.

EXAMPLE 1

77 kg of a commercial grade cobalt powder with an average particle size of about 50 microns were leached in an ammoniacal ammonium carbonate solution containing 180 gpl $NH_3$ and 65 gpl $CO_2$. The leach was carried out for 3 hours at a temperature of 80° C. under a total pressure of 550 kPa using air as an oxidant, the partial pressure of oxygen gas being 110 kPa. The final volume of the solution was 980 liters and the concentration of cobalt ions was 78 gpl, indicating that over 99% of the cobalt had dissolved. There were about 7 moles of total $NH_3$ present, compared to approximately 1.3 moles of Co and 1.5 moles of $CO_2$.

After undissolved solids had been filtered off, the leaching solution was diluted with about 10 times its own volume of water to reduce the concentration of cobalt ions to 6–7 gpl. The solution was then boiled with steam at 240 kPa for 3 hours to drive off $NH_3$ and $CO_2$ and precipitate cobalt oxide. The Fisher number of the cobalt oxide precipitate was 1.06.

Slurry from the precipitation step was passed to a settling tank and allowed to settle for 1 hour, after which the supernatant liquor was decanted. The remaining slurry was agitated, passed through a 100 mesh screen, and filtered over a pan filter, with the resultant filter cake then being washed.

The cobalt oxide cake was then fed at a controlled rate onto a moving belt passing through a reduction furnace containing a hydrogen atmosphere. The entrance and exit of the furnace were purged with nitrogen and the cobalt material was maintained at a temperature of 630° C. The speed of the moving belt was such that the cobalt material remained in the furnace for approximately 6 hours.

The cobalt powder product was discharged from the furnace into a container purged with argon, then pulverized in an enclosed disc pulverizer purged with argon, and packaged in air-tight polyethylene bags, which were then sealed in steel drums.

After pulverizing, the final cobalt powder product had a Fisher number of 1.35 and the oxygen content was 0.56%.

EXAMPLE 2

The procedure of Example 1 was followed up to the cobalt oxide precipitation step. Tests were made with different dilutions of the leach solution to give various concentrations of cobalt ions in the diluted solution. The results are shown in FIG. 1, from which the relationship between the Fisher number of precipitated cobalt oxide and cobalt ion concentration in the diluted solution can be readily observed.

In view of the foregoing description of preferred embodiments of the invention, other embodiments will be readily apparent to one skilled in the art, the scope of the invention being defined in the appended claims.

What we claim as new and desire to protect by Letters Patent of the United States is:

1. A process for producing ultrafine cobalt powder comprising providing an aqueous solution of cobalt ammine carbonate, with the concentration of cobalt ions being in the range of from about 1 to about 20 gpl, heating the solution to drive off ammonia and carbon dioxide and precipitate ultrafine cobalt oxide, separating the cobalt oxide precipitate from the solution, and heating the separated cobalt oxide precipitate in a reducing atmosphere to reduce the cobalt oxide to ultrafine cobalt powder.

2. A process according to claim 1 wherein the concentration of cobalt ions in the solution is adjusted to within the range of from about 5 to about 8 gpl.

3. A process according to claim 1 wherein the cobalt ammine carbonate in the aqueous solution is substantially wholly cobaltic ammine carbonate.

4. A process according to claim 1 wherein the aqueous cobalt ammine carbonate solution is prepared by leaching cobalt metal in ammoniacal ammonium carbonate solution under oxidizing conditions.

5. A process according to claim 4 wherein the leaching is continued until substantially all the dissolved cobalt is in the cobaltic state.

6. A process according to claim 4 wherein the leaching step is carried out at a temperature in the range of from about 50° to about 80° C. at a pressure in the range of from about 400 to about 1000 kPa, with an oxygen partial pressure in the range of from about 80 to about 200 kPa, and with the ammoniacal ammonium carbonate solution having a free ammonia to cobalt molar ratio of at least 3.

7. A process according to claim 4 wherein the concentration of cobalt ions in the leach solution is in the range of from about 20 to about 120 gpl, and the concentration of cobalt ions in the solution is adjusted to within the range of from about 1 to about 20 gpl by dilution with water.

8. A process according to claim 1 wherein the solution is heated by steam injected into the solution to drive off ammonia and carbon dioxide and precipitate ultrafine cobalt oxide.

9. A process according to claim 1 wherein the separated cobalt oxide precipitate is heated in a hydrogen atmosphere at a temperature within the range of from about 500° to about 775° C. to reduce the cobalt oxide to ultrafine cobalt powder.

10. A process according to claim 9 wherein the separated cobalt oxide precipitate is passed through a hydrogen atmosphere in a furnace, the furnace having an entrance and an exit purged by a gas which is chemically inert with respect to cobalt oxide and cobalt powder.

* * * * *